United States Patent [19]

Ikoma et al.

[11] Patent Number: 4,948,279

[45] Date of Patent: Aug. 14, 1990

[54] BIDIRECTIONAL PRINTING DEVICE

[75] Inventors: Keiichi Ikoma, Nara; Shizuo Nakai, Tenri; Tomokazu Obata, Yamatokoriyama; Kenji Miwa, Kitakatsuragi, all of Japan

[73] Assignee: Sharp Kabushiki Kaisha, Osaka, Japan

[21] Appl. No.: 347,208

[22] Filed: May 4, 1989

[30] Foreign Application Priority Data

May 9, 1988 [JP] Japan ..... 63-113290

[51] Int. Cl.[5] ..... B41J 19/30

[52] U.S. Cl. ..... 400/323; 400/279; 400/322

[58] Field of Search ..... 400/323, 84, 74, 903, 400/279, 322

[56] References Cited

U.S. PATENT DOCUMENTS 4,179,223 12/1979 Kwan ..... 400/323
4,840,281 2/1989 Yamakawa ..... 400/54

FOREIGN PATENT DOCUMENTS 62066 4/1983 Japan ..... 400/323
78789 5/1983 Japan ..... 400/279
19182 1/1984 Japan ..... 400/322
180871 9/1985 Japan ..... 400/323
236781 11/1985 Japan ..... 400/322
74874 4/1986 Japan ..... 400/322
199960 9/1986 Japan ..... 400/323
286181 12/1986 Japan ..... 400/279
124975 6/1987 Japan ..... 400/279

*Primary Examiner*—David A. Wiecking
*Assistant Examiner*—Steven S. Kelley

[57] ABSTRACT

A printer mounted on an electronic cash register (ECR) performs printing on printing paper by moving a print head left to right and right to left, i.e. bidirectionally. The printer uses right and left reset signals to determine the print start position and printing direction of the print head, the right and left reset signals being fed alternately and regularly to the driving circuit for the print head for performing bidirectional printing, thereby assuring correct bidirectional printing. The right and left reset signals are constantly monitored. If the reset signals of the same kinds are successively detected, it is judged that trouble has occurred, hampering correct bidirectional printing, and notice is issued accordingly.

11 Claims, 4 Drawing Sheets

BIDIRECTIONAL PRINTING DEVICE

BACKGROUND OF THE INVENTION

1. Field of the invention

The present invention relates to a bidirectional printing device which may be advantageously employed as a printing means mounted for example on an electronic cash register (ECR) or the like.

2. Description of the Prior Art

Bidirectional printing devices for printing characters by moving the print head in one direction, then in the reverse direction thereof, i.e. bidirectionally, are used as printing means for electronic cash registers. With such printing devices, one line is printed as the print head is moved in one direction, and another line as it is moved in the reverse direction. That is, two lines are printed while the print head completes one bidirectional travel. When not performing printing operation, the print head is placed in a standby position where it stopped at the end of the preceding printing operation (i.e. at one end of the printing paper width). When printing operation is resumed, the print head starts to move toward the printing area on the printing paper. When the print head is detected as having reached one end of the printing area width, a reset signal described below is produced, in response to which the printing operation by the print head is started.

The reset signal is produced, for example, in response to a normal/reverse rotation instructing signal which instructs the rotating direction of a drive motor for driving the print head and the output signal from an optical detecting means which optically detects the print head positioning. The reset signal is classified into two kinds, one being the right reset signal which is given to start printing from the right end toward the left end of the printing area, and the other being the left reset signal which is given to start printing from the left end toward the right end of the printing area. Both right and left reset signals are used to determine the print start position and printing direction of the print head. In continuous printing operation, the right and left reset signals are alternately produced.

In such a bidirectional printing device, either right or left reset signal can be lost, for example, because of disconnection in a circuit within the printing device. In such a case, e.g., if the right reset signal is lost when printing should be made by moving the print head from the right end toward the left end of the printing area, the printing operation may, for example, be suspended without issuing notice to the operator, or erroneous printing may be made because of erroneous response to the subsequently given left reset signal.

SUMMARY OF THE INVENTION

Accordingly, it is an object of the invention to provide a bidirectional printing device wherein: when trouble has occurred to the signal for instructing the start of printing, the trouble status is detected and, on the basis of the detected result, prescribed corrective measures are taken.

To achieve the above object, the invention provides a bidirectional printing device which performs line by line printing bidirectionally by printing means from a predetermined print start position to a predetermined print end position on printing paper, the bidirectional printing being performed in response to a left print start signal and a right print start signal produced for every line to be printed as the printing means reaches the respective print start positions, the bidirectional printing device including:

control means for determining if the current print start signal is of the same kind as the preceding print start signal, judging that trouble has occurred to the print start signal if the two signals are of the same kind, and thereafter performing a predetermined operation.

When the bidirectional printing device is performing bidirectional printing operation in a normal state, the left print start signal and the right print start signal are produced alternately. In this state, two successive signals are therefore of different kinds. On the other hand, if one of the print start signals is lost, for example, the subsequently issued signal will be of the same kind as the preceding signal, it is possible to detect a failure which has occurred to the print start signal.

The bidirectional printing device may be so constructed that when the failure as mentioned above is detected, the printing operation can be continued by using only the print start signal for the direction for which no failure has occurred.

Also, the invention provides a bidirectional printing device which is provided with a print head for printing on printing paper, the print head being moved in a first direction relative to the printing paper, then in a second direction which is reverse to the first direction for printing on the printing paper by reading out the printing contents stored in memory when the print head is moved in the first and second directions, the bidirectional printing device including:

start signal producing means for producing first and second start signals which instruct the start of printing by the print head when the print head is moved in the first and second directions respectively;

judging means for judging, in response to the first and second start signals, if the first start signal is preceded by the second start signal, upon reception of the first start signal, and if the second start signal is preceded by the first start signal, upon reception of the second start signal; and means for enabling printing of the memory contents by the print head in response to the outputs from the judging means when it is judged that reception of the first start signal is preceded by reception of the second start signal and when it is judged that reception of the second start signal is preceded by reception of the first start signal.

When the bidirectional printing device is performing continuous printing in a normal state, reception of the first start signal is followed by reception of the second start signal, and reception of the second start signal is followed by reception of the first start signal. Accordingly, when it is judged that reception of the first start signal is preceded by reception of the second start signal, and when it is judged that the second start signal is preceded by reception of the first start signal, it is judged that each start signal produced by the signal producing means has been received in a normal state, enabling printing of the memory contents by the print head.

In a preferred embodiment of the invention, the bidirectional printing device includes means for stopping the printing by the print head and producing a signal indicating the trouble status in response to the outputs from the judging means when the first start signal is immediately followed by another first start signal or when the second start signal is immediately followed by another second start signal.

In the bidirectional printing device, reception of the first start signal followed by another first start signal or reception of the second start signal followed by another second start signal means that each signal produced by the signal producing means has not been received in normal state, in which case a signal indicating the trouble state is produced, thereby making it possible to annunciate the trouble state.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above-mentioned and other objects as well as the features and advantages of the invention will become more apparent with reference to the following detailed description and the accompanying drawings which are given by way of illustration only, and thus are not limitative of the present invention, and wherein.

DETAILED DESCRIPTION OF THE PREFERRED EMBODIMENTS

With reference to the drawings, the preferred embodiments of the invention are hereinafter described in detail.

Figure 1:
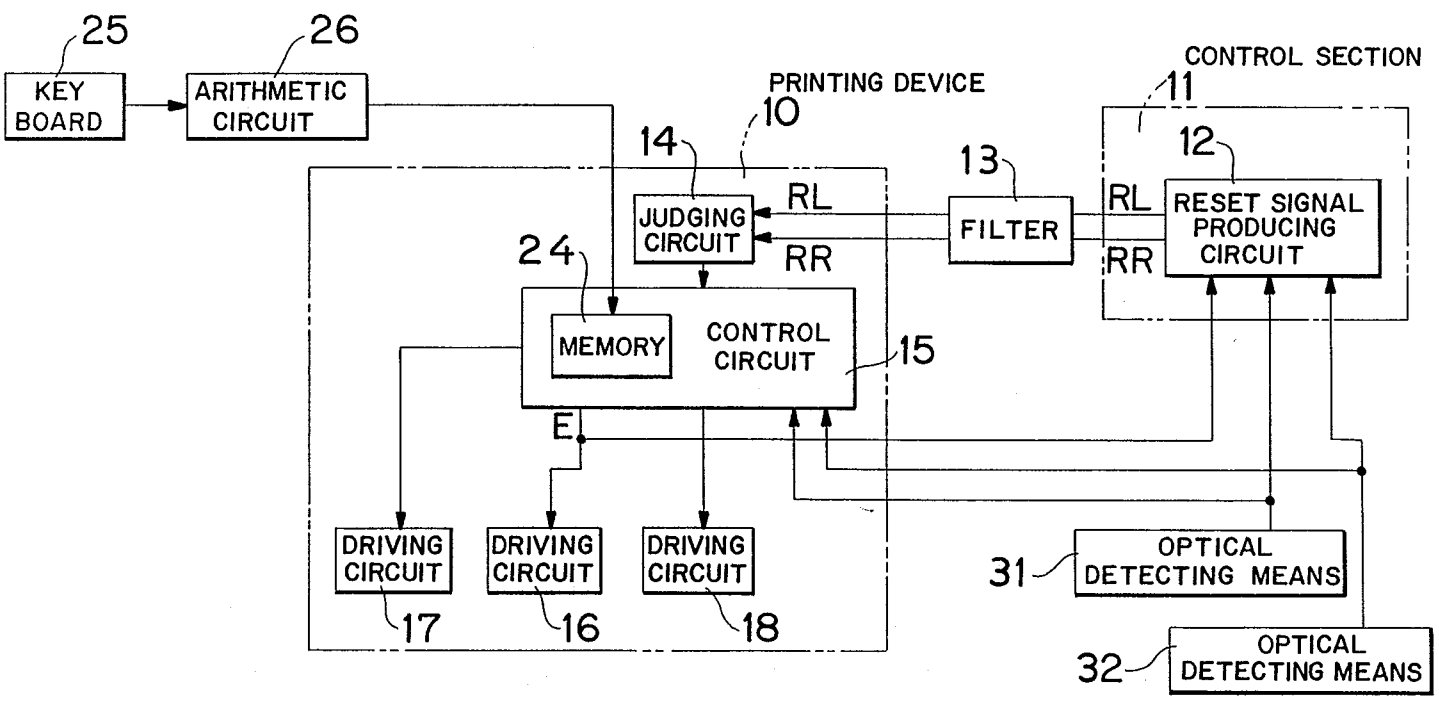
FIG. 1 is a block diagram illustrating the electrical construction of the bidirectional printing device in a preferred embodiment of the invention.
Figure 2:
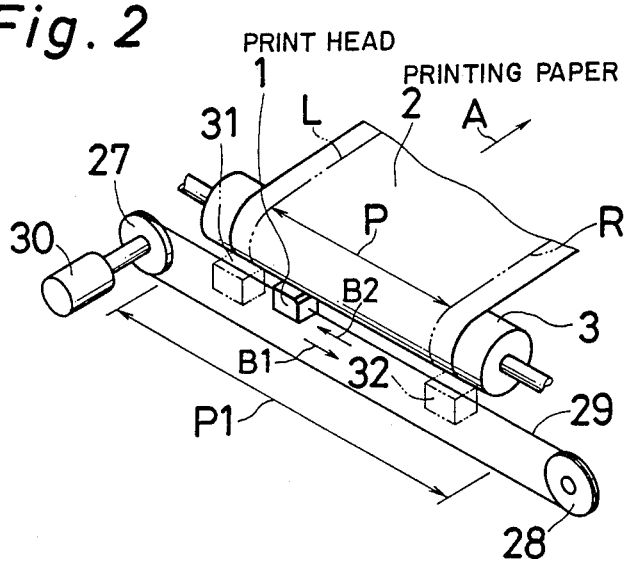
FIG. 2 is a perspective view showing the construction of the area adjacent to a print head 1.

FIG. 1 is a block diagram illustrating the electrical construction of a preferred embodiment of the invention. FIG. 2 is a perspective view showing the area adjacent to a print head 1. Printing paper 2 is loaded between the print head 1 and a platen 3, and is fed in the direction perpendicular to the axial direction of the platen 3 (in the direction of the arrow A shown in FIG. 2). The print head 1 is movable bidirectionally along the axial direction of the platen 3 within the print head moving range P1, and performs bidirectional printing on the printable area set between a left print start position L and a right print start position R on the printing paper 2.

A control section 11 for driving and controlling a printing device 10 includes a reset signal producing circuit 12 for producing reset signals to control the print head 1. The reset signal producing circuit 12 produces a left reset signal RL and a right reset signal RR hereinafter described. These reset signals RL and RR are fed through a filter 13 where noise is eliminated to a judging circuit 14 included in the printing device 10. The judging circuit 14 judges the kind of the reset signal that has been input, the information of which is fed to a control circuit 15. The control circuit 15 controls a driving circuit 16 for driving the print head 1 bidirectionally, a driving circuit 17 for driving the platen 3 in an intermittent rotating motion, and a print driving circuit 18 for causing the print head 1 to print printing data stored in memory 24.

The control circuit 15 has a memory 24 for storing data to be printed. The data input from a keyboard 25 undergoes prescribed arithmetic operation in an arithmetic circuit 26, and is stored as printing data in the memory 24. To print rightward (in the direction of the arrow B1 shown in FIG. 2), the printing data is sequentially sent out by addressing the memory 24 in the order appropriate for rightward printing control, and to print leftward, the printing data is sent out by addressing the memory 24 in the reverse direction.

The print head 1 is fixed to a wire 29 which is applied on a pair of pulleys 27 and 28. The rotating force of a drive motor 30 is transmitted to the pulley 27 to move the print head 1. The motor 30 is driven in the normal or reverse direction in response to the driving signal from the driving circuit 16. A control signal E from the control circuit 15 is given to the driving circuit 16. The control signal E contains the information for instructing the rotating direction of the motor 30.

Adjacent to the ends of the travel path of the print head 1, optical detecting means 31 and 32 are provided for optically detecting the positioning of the print head 1. The left print start position L and the right print start position R are detected by the detecting means 31 and 32, respectively.

The outputs from the optical detecting means 31 and 32 are fed to the reset signal producing circuit 12 along with the control signal E from the control circuit 15. The reset signal producing circuit 12 outputs a reset signal in response to the control signal E and the output from either optical detecting means 31 or 32.

The width of a printing area P which is set between the left print start position L and the right print start position R is set smaller than the travel of the print head set in the print head moving range P1. For bidirectional printing operation, the print head 1 is moved in one direction by the travel (=moving range P1) corresponding to the predetermined travelling time, and, after elapse of a given time, is moved in the reverse direction by the same time.

Figure 3:
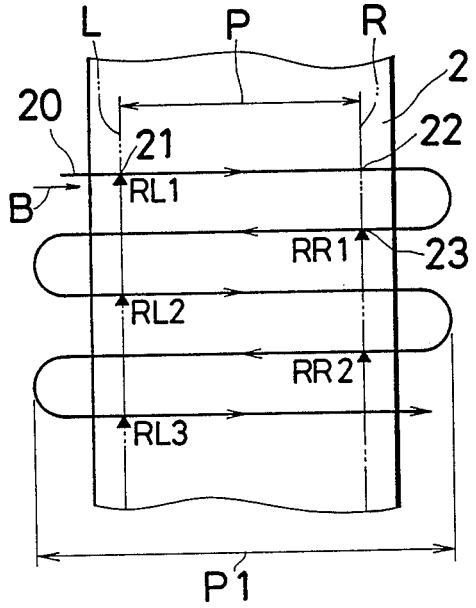
FIG. 3 is a diagram showing the locus of the print head 1 on printing paper 2 during printing operation.

FIG. 3 is a diagram showing the locus of the print head 1 on the printing paper 2 during printing operation. In the bidirectional printing device, when not performing printing operation, the print head 1 is placed in a stationary state at the position where it stopped at the end of the preceding printing operation. Prior to initiation of printing operation, the print head 1 starts to move.

After the print head 1 reaches the printing area P, characters to be printed are printed on the printing paper 2. The timing at which the printing operation starts when the print head 1 has reached the printing area P is determined by the reset signal produced by the reset signal producing circuit 12. For example, supposing the print head 1 is stationary at the position indicated by the reference numeral 20 and then starts to move in the direction of the arrow B, when the print head 1 reaches the right print start position L indicated by the reference numeral 21 on the printing paper 2, the state is detected by the detecting means 31 to cause a left reset signal RL1 to be produced by the reset signal producing circuit 12. In response to the left reset signal RL1, the print head 1 starts to print while being moved in the direction of the arrow B.

When the print head 1 reaches the position indicated by the reference numeral 22, the state is detected by the detecting means 32 to end the printing for the line, the printing operation being suspended till the print head 1 reaches the position indicated by the reference numeral 23. When the print head 1 reaches the right print start position R, indicated by the reference numeral 23, on the printing paper 2, the state is detected by the detecting means 31 to cause a right reset signal RRI to be produced to resume the printing operation. The printing operation by the print head 1 is thus initiated in response to the left reset signal RL and the right reset signal RR to continuously perform bidirectional printing.

Figure 4:
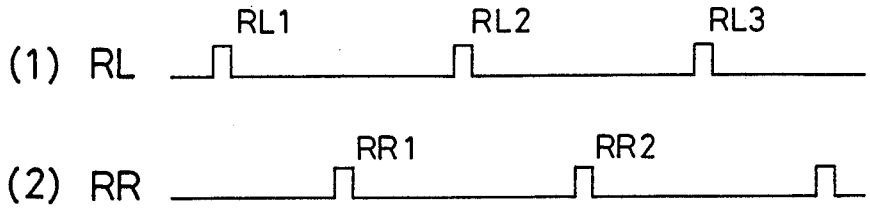
FIG. 4 is a timing chart for a left reset signal RL and a right reset signal RR.
Figure 5:
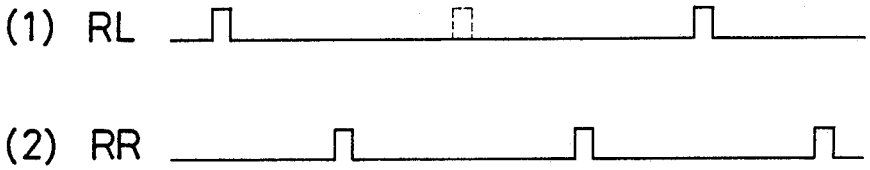
FIG. 5 is a timing chart showing the state when a failure has occurred to the left reset signal RL.
Figure 6:
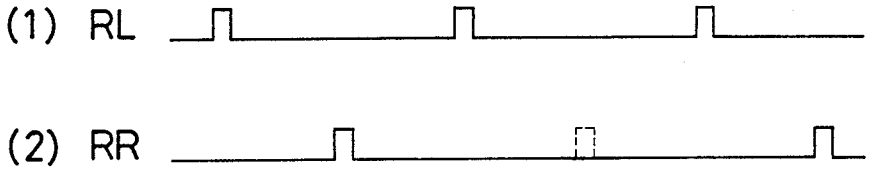
FIG. 6 is a timing chart showing the state when a failure has occurred to the right reset signal RR.

When printing operation is performed in the normal state as described above, the left and right reset signals RL and RR are produced alternately as shown in FIG. 4. Accordingly, the control circuit 15 judges that printing operation is being performed in a normal state when the left reset signal RL and the right reset signal RR are being input alternately. On the other hand, if two right reset signals RR, for example, are input successively, it is judged that the left reset signal RL which should be given between the right reset signals RR has been lost. (Refer to FIG. 5) Likewise, if two left reset signals RL are input successively, it is judged that the right reset signal RR which should be input between the left reset signals RL has been lost (Refer to FIG. 6) Trouble for the reset signal is thus detected. The possible cause of omission of the reset signal includes, for example, disconnection between the control section 11 and the printing device 10.

For performing such judgement, when the left reset signal RL is input to the judging circuit 14, a data flag RLF is set in the control circuit 15, indicating that the left reset signal RL has been given. Likewise, when the right reset signal RR is input to the judging circuit 14, a data flag RRF is set, indicating that the right reset signal RR has been given. Thus, in the control circuit 15, a flag is set to indicate the kind of the preceding reset signal, thereby permitting comparison of the currently input reset signal with the kind of the preceding reset signal and judging that the other kind of reset signal has been lost if the two successive reset signals are of the same kind.

Figure 7:
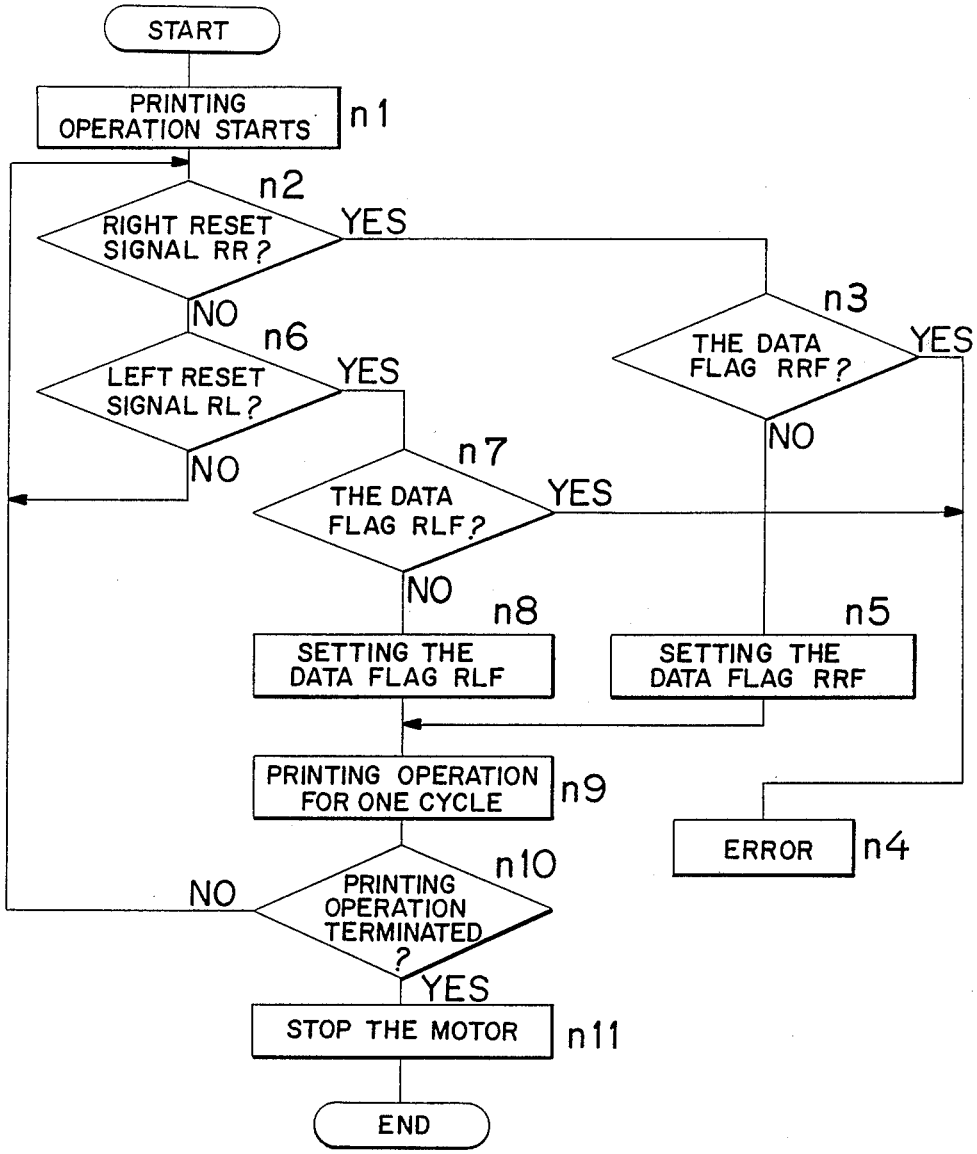
FIG. 7 is a flow chart explaining the operation of the bidirectional printing device.

FIG. 7 is a flow chart explaining the operation of the bidirectional printing device.

In step n1, the motor 30 for moving the print head 1 bidirectionally is started to initiate a series of printing operations. In step n2, it is checked if the right reset signal RR is input to the judging circuit 14, and if yes, the operation proceeds to step n3. In step n3, it is checked if the data flag RRF is set to indicate generation of a right reset signal RR preceding the current reset signal. If yes, since it is judged that two successive right reset signals have been input to the judging circuit 14, the operation proceeds to step n4 to process the error.

If it is judged in step n3 that the data flag RFL is set, since it is judged that the reset signal have been input to the judging circuit 14 in normal state, setting the data flag RRF in step n5, and the operation proceeds to step n9.

If it is checked in step n2 that the right reset signal RR is not input, it is checked in step n6 if the left reset signal RL is input. If yes, the operation proceeds to step n7, and if no, the operation returns to n2. In step n7, it is checked if the data flag RLF is set to indicate generation of a left signal preceding the current reset signal. If yes, since it is judged that two successive left reset signals have been input to the judging circuit 14, the operation proceeds to step n4 to process the error.

When the data flag RRF is set in step n7, the operation proceeds to step n8 to set the data flag RLF, and in step n9, printing operation for one cycle is performed.

In step n10, it is judged if the printing operation should be terminated, and if no, the operation returns to step n2. If yes, the operation proceeds to step n11 to stop the motor and to terminate the printing operation.

The error processing in step n4 may include, for example, annunciation of the absence of the reset signal by means of a display or a buzzer. Also, in the case of the absence of the reset signal, the printing operation thereafter may be performed by using only the reset signal for the direction for which no failure has occurred. Thus, it is possible to continue the printing operation in a normal state without stopping the printing operation or without performing erroneous printing, although the printing speed is reduced to half.

The bidirectional printing device may also be constructed in such a way that the motor runs only in one direction to feed the print head 1 bidirectionally over the moving range P1, or other alternative construction may be conceived.

Also, it may be so constructed that instead of moving the print head 1, the platen is moved bidirectionally.

Furthermore, bidirectional printing may be performed dot by dot instead of line by line.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A bidirectional printing device which performs line by line printing bidirectionally by printing means from a predetermined print start position to a predetermined print end position on a medium, the bidirectional printing being performed in response to one of two types of print start signals, a first type of print start signal being a left print start signal and a second type of print start signal being a right print start signal, one of the two types of print start signals being produced for every line to be printed as the printing means reaches the respective print start positions, the bidirectional printing device including:

control means for determining if the current print start signal is of the same type of print start signal as the preceding print start signal, for judging that trouble has occurred to the print start signal if two consecutive determined signals are of the same type, and thereafter for enabling printing in both directions if trouble fails to be judged.

2. The bidirectional printing device as recited in claim 1, further comprising direction controlling means for enabling printing in the right direction and prohibiting printing in the left direction when two consecutive right print start signals are judged by the control means, said direction controlling means further enabling printing in the left direction and prohibiting printing in the right direction when two consecutive left print start signals are judged by the control means.

3. The bidirectional printing device as recited in claim 2, further comprising alarm means for informing a user that two consecutive signals are judged by the control means to be of the same type.

4. The bidirectional printing device as recited in claim 1, further comprising means for stopping printing by the print head in both directions when two consecutive signals are judged by the control means to be of the same type.

5. The bidirectional printing device as recited in claim 4, further comprising alarm means for informing a user that two consecutive signals are judged by the control means to be of the same type.

6. A bidirectional printing device provided with a print head for printing on a medium, the print head being movable in a first direction relative to the medium, then in a second direction which is reverse to the first direction for printing on the medium by reading out printing contents stored in memory when the print head is moved in the first and second directions, the bidirectional printing device comprising:

start signal producing means for producing first and second start signals which instruct the start of printing by the print head when the print head is moved in the first and second directions, respectively;

judging means for judging, in response to the first and second start signals, if the first start signal is preceded by the second start signal, upon reception of the first start signal, and if the second start signal is preceded by the first start signal, upon reception of the second start signal; and means for enabling printing of the memory contents by the print head in response to the outputs from the judging means when it is judged that reception of the first start signal is preceded by reception of the second start signal and when it is judged that reception of the second start signal is preceded by reception of the first start signal.

7. The bidirectional printing device as recited in claim 2, further comprising:

means for stopping the printing by the print head and for producing a signal indicating trouble in response to the outputs from the judging means when the first start signal is immediately followed by another first start signal or when the second start signal is immediately followed by another second start signal.

8. The bidirectional printing device as recited in claim 6, further comprising direction controlling means for enabling printing in the first direction and prohibiting printing in the second direction when the judging means judges a first start signal is preceded by a first start signal, said direction controlling means further enabling printing in the second direction and prohibiting printing in the first direction when the judging means judges a second start signal is preceded by a second start signal.

9. The bidirectional printing device as recited in claim 8, further comprising alarm means for informing a user that the judging means judges a first start signal is preceded by a first start signal or judges a second start signal is preceded by a second start signal.

10. The bidirectional printing device as recited in claim 6, further comprising means for stopping printing in both directions when the judging means judges the first start signal is preceded by a first start signal or judges the second start signal is preceded by a second start signal.

11. The bidirectional printing device as recited in claim 10, further comprising alarm means for informing a user that the judging means judges a first start signal is preceded by a first start signal or judges a second start signal is preceded by a second start signal.

* * * * *